US012509192B2

(12) United States Patent
Westrick et al.

(10) Patent No.: US 12,509,192 B2
(45) Date of Patent: Dec. 30, 2025

(54) PONTOON/TRITOON WATERCRAFT WITH CROSS-HATCHED CHASSIS

(71) Applicant: Hyper Electric Marine Inc., Huntertown, IN (US)

(72) Inventors: Michael D. Westrick, Huntertown, IN (US); Griff Suelzer, Coldwater, MI (US); Steven V. Werling, Hudson, IN (US); Kaleb J. Reinhart, Huntertown, IN (US); Matthew R. Williams, Fort Wayne, IN (US)

(73) Assignee: Hyper Electric Marine, Inc., Huntertown, IN (US)

( * ) Notice: Subject to any disclaimer, the term of this patent is extended or adjusted under 35 U.S.C. 154(b) by 630 days.

(21) Appl. No.: 17/737,464

(22) Filed: May 5, 2022

(65) Prior Publication Data

US 2023/0356811 A1 Nov. 9, 2023

(51) Int. Cl.
*B63B 35/38* (2006.01)
*B63B 1/12* (2006.01)

(52) U.S. Cl.
CPC ..... *B63B 35/38* (2013.01); *B63B 1/121* (2013.01); *B63B 2001/123* (2013.01); *B63B 1/125* (2013.01)

(58) Field of Classification Search
CPC ..... B63B 35/38; B63B 1/121; B63B 1/125
See application file for complete search history.

(56) References Cited

U.S. PATENT DOCUMENTS

| | | | | |
|---|---|---|---|---|
| 1,773,999 | A * | 8/1930 | Haight | B63B 35/52 405/1 |
| 2,412,578 | A * | 12/1946 | Harris | B63B 71/00 114/46 |
| 3,968,532 | A * | 7/1976 | Bailey | B63B 1/121 114/352 |
| 4,892,052 | A * | 1/1990 | Zook | B63B 3/48 114/355 |
| 5,325,623 | A | 7/1994 | Sakuraoka et al. | |
| 6,302,042 | B1 * | 10/2001 | Biedenweg | B63B 35/613 114/292 |
| 7,004,092 | B2 * | 2/2006 | Yetter | B63B 35/38 114/292 |
| 7,263,940 | B2 | 9/2007 | Yetter et al. | |
| 8,714,099 | B1 * | 5/2014 | Manderfeld | B63B 35/613 114/356 |
| 8,955,452 | B1 * | 2/2015 | Wilson | B63B 35/613 114/61.1 |
| 9,073,605 | B2 * | 7/2015 | Hall | B63B 17/0081 |
| 9,862,468 | B2 * | 1/2018 | O'Sullivan | B63B 41/00 |
| 10,427,769 | B1 * | 10/2019 | Garrett | B62H 3/02 |
| 11,091,234 | B1 * | 8/2021 | Rose | B63B 35/34 |
| 2009/0297310 | A1 * | 12/2009 | Heck | B60P 3/1033 414/803 |
| 2023/0356811 | A1 * | 11/2023 | Westrick | B63B 1/121 |

* cited by examiner

*Primary Examiner* — S. Joseph Morano
*Assistant Examiner* — Jovon E Hayes
(74) *Attorney, Agent, or Firm* — TAYLOR & EDELSTEIN, PC

(57) ABSTRACT

A watercraft includes: a watercraft body; a pontoon frame system coupled with the watercraft body, the pontoon frame system including: a plurality of pontoons spaced apart from one another; and a chassis coupled with and at least partially supporting the watercraft body, the chassis supported by and coupling together the plurality of pontoons, the chassis including a cross-hatched assembly.

20 Claims, 5 Drawing Sheets

PONTOON/TRITOON WATERCRAFT WITH CROSS-HATCHED CHASSIS

BACKGROUND OF THE INVENTION

1. Field of the Invention

The present invention relates to boats using two or more pontoons, and, more particularly, to the chassis of such boats.

2. Description of the Related Art

Certain boats (which can be referred to herein as watercraft) may include two or more pontoons as floatation devices. Boats that use two pontoons are herein referred to as pontoon boats, and boats that use three pontoons are herein referred to as tritoon boats. Pontoons are tubes (which can be referred to as floatation tubes) or hulls that are airtight and hollow so that they are able to float, and they are made of known materials.

Pontoon and tritoon boats suffer from excessive twisting of the pontoon frame system (which includes the pontoons and the chassis) under high speed and/or rough water conditions. Such twisting results in weaking of connective fasteners attached to the pontoons and the chassis. Additionally, such twisting creates an unpleasant ride for passengers in the boat, thus diminishing the ride experience.

What is needed in the art is a way to improve the rigidity of the chassis so as to mitigate the twisting of pontoon/tritoon watercraft when traveling at high speeds or through rough water.

SUMMARY OF THE INVENTION

The present invention provides a chassis of pontoon/tritoon watercraft that mitigates twisting when traveling at high speeds or through rough water, the chassis including a cross-hatch assembly.

The invention in one form is directed to a pontoon frame system of a watercraft including a watercraft body, the pontoon frame system being coupled with the watercraft body, the pontoon frame system including: a plurality of pontoons paced apart from one another; and a chassis configured for being coupled with and for at least partially supporting the watercraft body, the chassis supported by and coupling together the plurality of pontoons, the chassis including a cross-hatched assembly.

The invention in another form is directed to a watercraft including: a watercraft body; a pontoon frame system coupled with the watercraft body, the pontoon frame system including: a plurality of pontoons spaced apart from one another; and a chassis coupled with and at least partially supporting the watercraft body, the chassis supported by and coupling together the plurality of pontoons, the chassis including a cross-hatched assembly.

The invention in yet another form is directed to a method of using a watercraft, the method including the steps of: providing that the watercraft includes: a watercraft body; a pontoon frame system coupled with the watercraft body, the pontoon frame system including: a plurality of pontoons spaced apart from one another; and a chassis coupled with and at least partially supporting the watercraft body, the chassis supported by and coupling together the plurality of pontoons, the chassis including a cross-hatched assembly; and floating the watercraft.

An advantage of the present invention is that the chassis of the pontoon/tritoon watercraft is more rigid and stable. That is a chassis with a cross-hatch assembly attaching the floatation tubes to the floor of the pontoon/tritoon watercraft ensures resistance to twisting when traveling at high speeds and/or through rough water.

Another advantage of the present invention is that it adds very little additional weight to the overall watercraft.

Yet another advantage of the present invention is that it can provide additional space underneath the floor of the watercraft for placement of high voltage batteries for use in an all-electric boat design.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

The terms "forward", "rearward", "left" and "right", when used herein in connection with the watercraft and/or components thereof, are usually determined with reference to the direction of forward operative travel of the watercraft, but they should not be construed as limiting. The terms "longitudinal" and "transverse" are determined with reference to the fore-and-aft direction of the watercraft and are equally not to be construed as limiting. The terms "downstream" and "upstream" are analogous to "rearward" and "forward," respectively.

Figure 1:
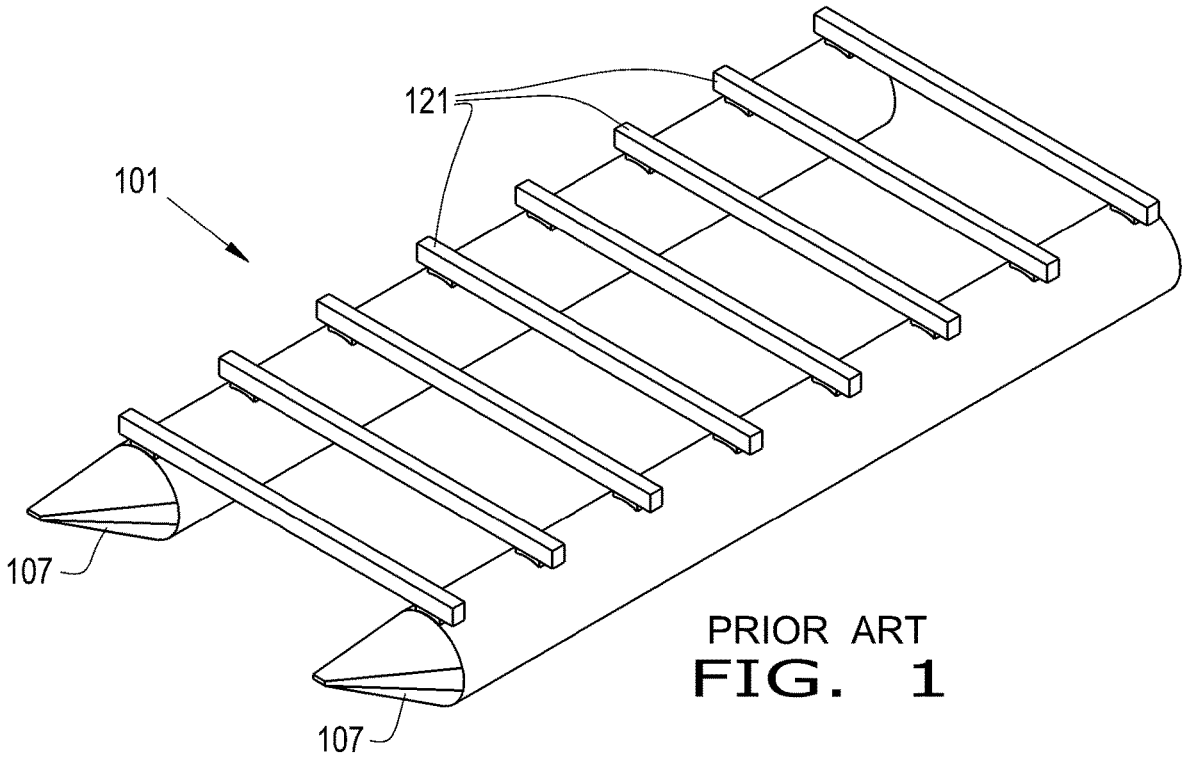
PRIOR ART FIG. 1
FIG. 1 is a top, perspective view of a watercraft of the prior art, with portions broken away.

Referring now to the drawings, and more particularly to FIG. 1, there is shown a top, perspective view of a prior art watercraft 101 (more specifically, a pontoon boat), with portions broken away. Watercraft 101 includes a plurality of pontoons 107, two being shown in FIG. 1, but it can be appreciated that a third pontoon can be added midway between the two pontoons 107 that are shown, thereby making a tritoon boat. Watercraft 101 further includes a chassis having a plurality of transverse beams 121 coupled with each of the pontoons 107. Though not shown, transverse beams 121 can be coupled with risers, a floor, furniture, trim, and railings.

Figure 2:
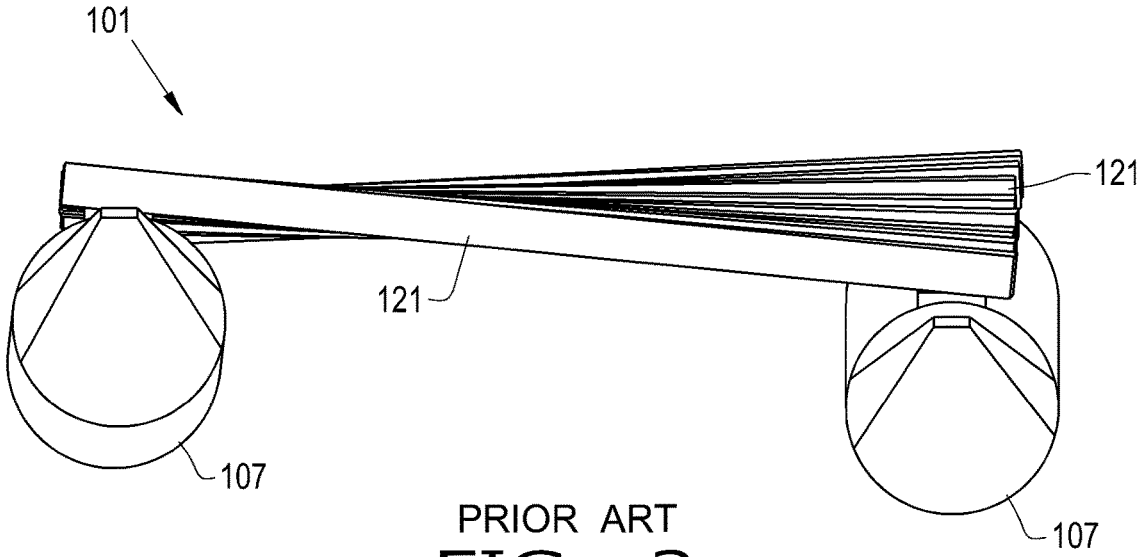
PRIOR ART FIG. 2
FIG. 2 is front view of the watercraft of FIG. 1, the watercraft being shown in a twisted configuration.

Referring now to FIG. 2, there is shown a front view of watercraft 101, which is shown in a twisted configuration. Watercraft 101 is shown to be suffering from excessive twisting, which can be caused, for example, by high-speed travel across the water and/or by rough water conditions. Watercraft 101 is not rigid enough to prevent such twisting of the chassis under such conditions.

Figure 3:
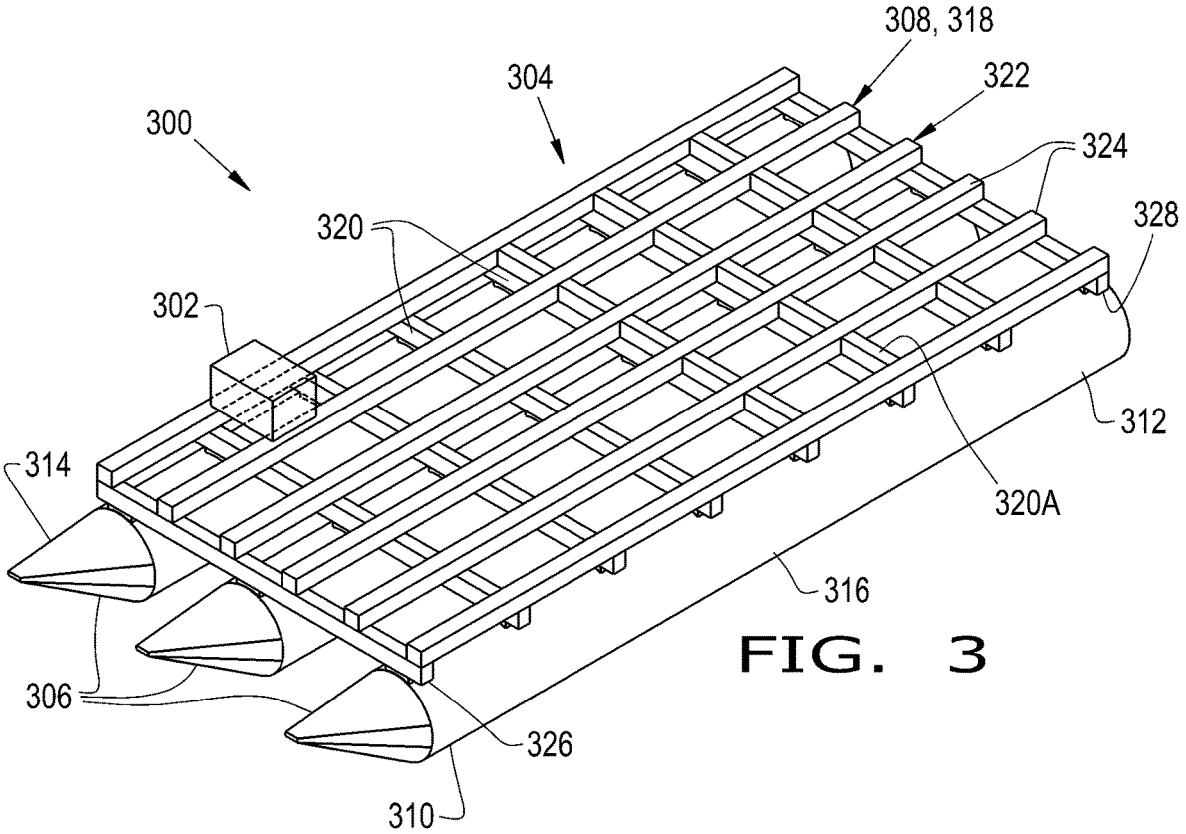
FIG. 3 is a top, perspective view of an exemplary embodiment of a watercraft, the watercraft including a pontoon frame system including pontoons and a chassis with a cross-hatched assembly, in accordance with an exemplary embodiment of the present invention.

Referring now to FIG. 3, there is shown a watercraft 300 (which can be referred to herein as a boat 300), according to the present invention. Watercraft 300 generally includes a watercraft body 302 and a pontoon frame system 304 coupled with the watercraft body 302 in any suitable manner. The watercraft body 302 is shown schematically and can include the parts of the watercraft mounted primarily atop the pontoon frame system 304; these parts can include, by way of example and not limitation, a floor, decking, a platform, railings, furniture, a helm, and any other structures that are mounted on top of the floor. Though shown relatively small in FIG. 1, watercraft body 302 can span at least the entire longitudinal and transverse extent of chassis 308.

Figure 4:
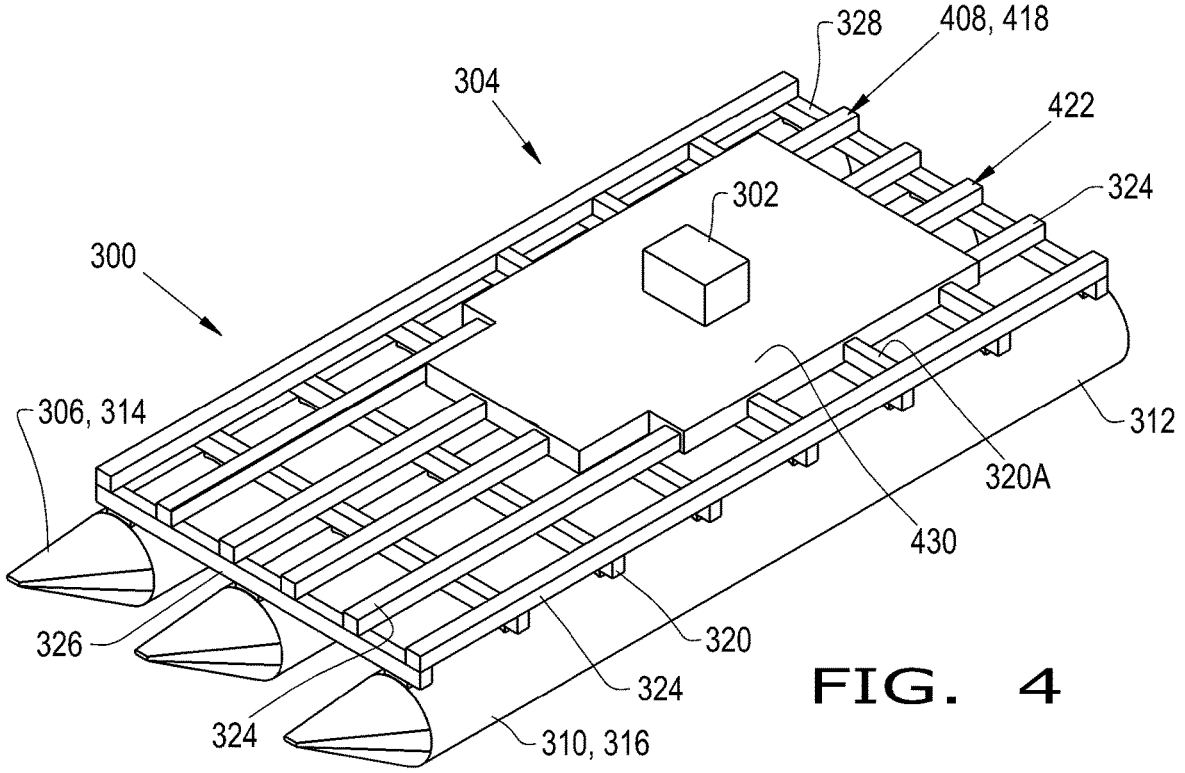
FIG. 4 is a top, perspective view of another exemplary embodiment of a watercraft, the watercraft including a pontoon frame system including pontoons and a chassis including a cross-hatched assembly with a high-voltage battery pack, in accordance with an exemplary embodiment of the present invention.

Pontoon frame system 304 incudes a plurality of pontoons 306 and a chassis 308. Pontoons 306 are spaced apart from one another in a transverse direction and extend in a longitudinal direction of watercraft 300. As is known, watercraft 300 with pontoons 306 typically includes two pontoons 306 (a pontoon boat) or three pontoons 306 (a tritoon boat). Though FIGS. 3-4 show watercraft 300 of the present invention formed as a tritoon boat, it can be readily appreciated that the watercraft of the present invention can be formed as a pontoon boat in the figures by removing the middle pontoon (as well as features of watercraft 300 associated with the middle pontoon 306). Pontoons 306 include a forward end 310, a rearward end 312, a first outboard pontoon 314, and a second outboard pontoon 316. Regarding a tritoon boat (as shown), the outboard pontoons 314, 316 are the transverse side pontoons 306. It can be appreciated that if the watercraft has only two pontoons 306 (a pontoon boat), then the two pontoons 306 can still be deemed to be first and second outboard pontoons, respectively.

Chassis 308 of pontoon frame system 304 is coupled with and at least partially supports watercraft body 302. Chassis 308 can be coupled with watercraft body 302 in any suitable manner. Further, chassis 308 is supported by and couples together pontoons 306 in any suitable manner. Chassis 308 includes a cross-hatched assembly 318 coupled with each pontoon 306 at forward end 310 and rearward end 312 of pontoons 306. Cross-hatched assembly 318 can have any suitable overall basic shape, such as a slab (shown) or the like. Cross-hatched assembly 318 provides a non-flexible chassis 308 that will maintain stability while watercraft 300 is travelling fast across the water and/or in rough water.

Cross-hatched assembly 318 includes a plurality of transverse members 320 and a support mechanism 322. Transverse members 320 include a first transverse member 328 positioned at forward end 310 and a second transverse member 328 positioned at rearward end 312. First transverse member 328 and second transverse member 328 are each coupled with first outboard pontoon 314 and second outboard pontoon 316. Transverse members 320 can include a plurality of beams 320. FIG. 3 shows each transverse member 320 formed as a beam 320. Each transverse member 320 can be made of any suitable material, such as a metal (such as aluminum, or steel), a polymer, carbon fiber, and/or fiberglass. Further, at least certain ones of transverse members 320 can be connected to pontoons 306, and these connections can be made in any suitable way, such as by way of fasteners (such as screws, bolts, rivets), brackets, welding, and/or the like, and any devices making these connections can be made of any suitable material, such as aluminum, steel, carbon fiber, fiberglass, and/or the like.

Support mechanism 322 is coupled with, extends longitudinally between, and is positioned atop at least certain ones of transverse members 320, including first transverse member 328 and second transverse member 328. FIG. 3 shows support mechanism 322 including a plurality of longitudinal members 324. Longitudinal members 324 includes a plurality of beams 324; according to the embodiment of the present invention shown in FIG. 3, each longitudinal member 324 is formed as a beam 324. Each of longitudinal members 324 can be positioned atop a series of respective transverse members 320, forming the cross-hatched design. Further, each longitudinal member 324, as shown in FIG. 3, can extend from first transverse member 326 to second transverse member 328. Further, as shown in FIG. 3, one or more longitudinal members 324 are positioned transversely offset relative to adjacent ones of pontoons 306; stated another way, such longitudinal members 324 are positioned between adjacent pontoons 306, though such longitudinal members 324 can be positioned above a top plane of such pontoons 306. Further, longitudinal members 324 can be made of any suitable material, such as a metal (such as aluminum, or steel), a polymer, carbon fiber, and/or fiberglass. Longitudinal members 324 can be connected to transverse members 320 (for example, each of transverse members 320) in any suitable way, such as by way of fasteners (such as screws, bolts, rivets), brackets, welding, and/or the like, and any devices making these connections can be made of any suitable material, such as aluminum, steel, carbon fiber, fiberglass, and/or the like.

Further, cross-hatched assembly 318 can further include transverse members 320A, as shown in FIG. 3. Transverse members 320A are interspersed between adjacent longitudinal members 324 and can be on a substantially similar plane as longitudinal members 324, providing additional strength in select areas of cross-hatched assembly 318. Transverse members 320A can be stacked atop respective ones of transverse members 320. Further, transverse members 320A can be made of any suitable material, such as a metal (such as aluminum, or steel), a polymer, carbon fiber, and/or fiberglass. Transverse members 320A can be connected to transverse members 320 and/or longitudinal members 322 in any suitable way, such as by way of fasteners (such as screws, bolts, rivets), brackets, welding, and/or the like, and any devices making these connections can be made of any suitable material, such as aluminum, steel, carbon fiber, fiberglass, and/or the like.

Referring now to FIG. 4, there is shown a top, perspective view of another embodiment of the chassis of watercraft 300, according to the present invention. Certain prior reference numbers with respect to the chassis are increased by a multiple of 100 and are substantially similar to the structures and function of the embodiments shown in FIGS. 3, unless otherwise shown and/or described. Thus, the chassis and cross-hatched assembly are now labeled 408 and 418, respectively, in FIG. 4. The primary difference between chassis 308 and chassis 408 is that chassis 408 includes a rigid enclosure 430 (which can also be referred to herein as case, shell, or pack 430). More specifically, chassis 408 includes transverse members 320 and support mechanism 422. Support mechanism 422, as with the embodiment in FIG. 3, is coupled with, extending longitudinally between, and is positioned atop first transverse member 326 and second transverse member 238. Support mechanism 422 includes longitudinal members 324 and rigid enclosure 430. Each longitudinal member 324 can be positioned atop transverse members 320, and rigid enclosure 430 can be positioned atop transverse members 320. Respective ones of longitudinal members 324 are coupled with first transverse member 326, and respective ones of longitudinal members 324 are coupled with second transverse member 328, as shown in FIG. 4. Further, cross-hatch assembly 418 can further include transverse members 320A, as shown in FIG. 4, which can be interspersed between longitudinal member 324 and enclosure 430. Further, rigid enclosure 430 can be connected to at least two longitudinal members 324, at least one of these two longitudinal members 324 being coupled with first transverse member 326, and at least another of these two longitudinal members 324 being coupled with second transverse member 328. Longitudinal members 324, transverse members 320, and transverse members 320A can be coupled with one another as discussed above and/or with enclosure 430 in any suitable way, such as by way of fasteners (such as screws, bolts, rivets), brackets, welding, and/or the like, and any devices making these connections can be made of any suitable material, such as aluminum, steel, carbon fiber, fiberglass, and/or the like. Enclosure 430 thus replaces certain parts of longitudinal members 324 and transverse members 320A. During assembly, for example, certain portions of longitudinal members 324 and transverse members 320A can be removed to make way for inserting enclosure 430 within the cross-hatched assembly 418 and attaching it therein. Enclosure 430 is rigid so as to offset the removal of respective ones of longitudinal members 324 and transverse members 320A; that is, the rigidity of enclosure 430 provides the stiffness and stability lost by removal of longitudinal members 324 and transverse members 320A displaced by enclosure 430. Thus, as shown in FIG. 4, enclosure 430 is situated within a top layer of cross-hatched assembly 418 including longitudinal members 324 and transverse members 320A, transverse members 320 occupying a bottom layer of cross-hatched assembly 418. By cross-hatch assembly 418 being layered in this way, additional space is provided underneath flooring of watercraft body 302 in which to locate enclosure 430. Though enclosure 430 is shown in a specific position within cross-hatch assembly 418 in FIG. 4, it can be appreciated that enclosure 430 can be positioned any suitable location as a part of cross-hatch assembly 418, whether horizontally or vertically repositioned in cross-hatch assembly 418. According to optional embodiments of the present invention (not shown), enclosure 430 may be positioned only in the bottom layer of cross-hatched assembly 418 (thus taking the place of portions of transverse members 320), or may be positioned in the top and bottom layers of cross-hatched assembly 418, together with members 320, 320A, and 324.

Enclosure 430 can be formed as a rigid, cased, high-voltage battery pack 430. Pack 430, being under the floor (part of watercraft body 302), is isolated from passengers above the floor. Access can be had to pack 430 in any suitable manner. Pack 430 can be formed of any suitable material, and may include a substantially rigid shell. Pack 430 can be used, for example, as part of an all-electric boat design (a boat powered by electricity). Pack 430 can include therein one or more batteries as is suitable for the intended use. Further, any or all high voltage and high current cables can be at least partially contained or encapsulated within pack 430 and/or otherwise routed underneath the flooring of watercraft body 302 as well, eliminating the risk of accidental electrocution. Any such cables may route to an inverter and/or an outboard motor.

Figure 5:
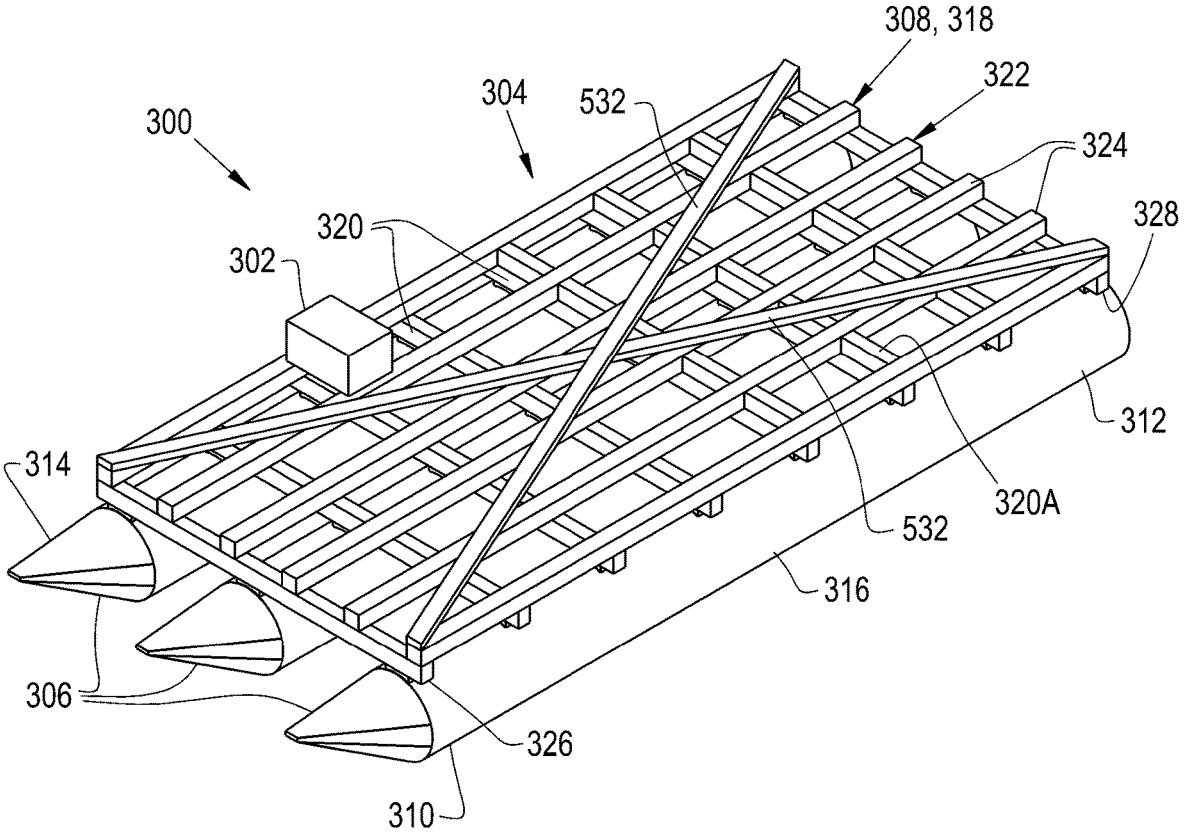
FIG. 5 is a top, perspective view of yet another exemplary embodiment of a watercraft, in accordance with an exemplary embodiment of the present invention.

Referring now to FIG. 5, there is shown a top, perspective view of another embodiment of the chassis of watercraft 300, according to the present invention. The primary difference between FIGS. 3 and 5 is the addition of two criss-crossed braces 532 as a part of chassis 308. Braces 532 can be relatively thin, flat strips. Braces 532 can be made of any suitable material, such as a metal (such as aluminum, or steel), a polymer, carbon fiber, and/or fiberglass. Further, braces 532 can be laid atop one and attached to one another in any suitable manner, such as by way of fasteners (such as screws, bolts, rivets), brackets, welding, and/or the like, and any devices making these connections can be made of any suitable material, such as aluminum, steel, carbon fiber, fiberglass, and/or the like. Further, braces 532 can be laid atop and attached to support mechanism 322, longitudinal members 324, and transverse members 320A in any suitable manner, such as by way of fasteners (such as screws, bolts, rivets), brackets, welding, and/or the like, and any devices making these connections can be made of any suitable material, such as aluminum, steel, carbon fiber, fiberglass, and/or the like. Braces 532 can, in particular, be attached in any suitable way to diagonal corners a rectangular shape formed by the collection of beams 320, 320A, 322, 324 as shown, or at ends of outermost beams, or at longitudinal ends of longitudinal members 324. Braces 532 serve to help prevent racking, that is, parallelogram distortion, wherein the rectangular shape formed by beams 320, 320A, 322, 324 can distort into parallelograms as one side of chassis 308 moves relative to the other side. Thus, the addition of braces 532 adds stiffness to chassis 308 and helps to prevent harmful stresses that would occur at joints between beams 320, 320A, 322, 324 (or, box beams) if one pontoon 306 were to experience more drag than the other pontoon 306, or only one pontoon 306 strikes a wave Further, though braces 532 are described and shown as being atop the other beams, braces 532, at their longitudinal ends, can be attached lower on beams 324 and/or to transverse beams 320, using brackets and/or by being bent, for example. According to another embodiment of the present invention, only one brace 532 is used. In sum, as shown in FIG. 5, cross-hatch assembly 318 includes transverse members 320, 320A, longitudinal members 324 coupled with transverse members 320, 320A, and at least one brace member 532 coupled with and disposed diagonally relative to transverse members 320, 320A and longitudinal members 324. The embodiment of the present invention shown and/or described with respect to FIG. 5 can also include enclosure 430.

Figure 6:
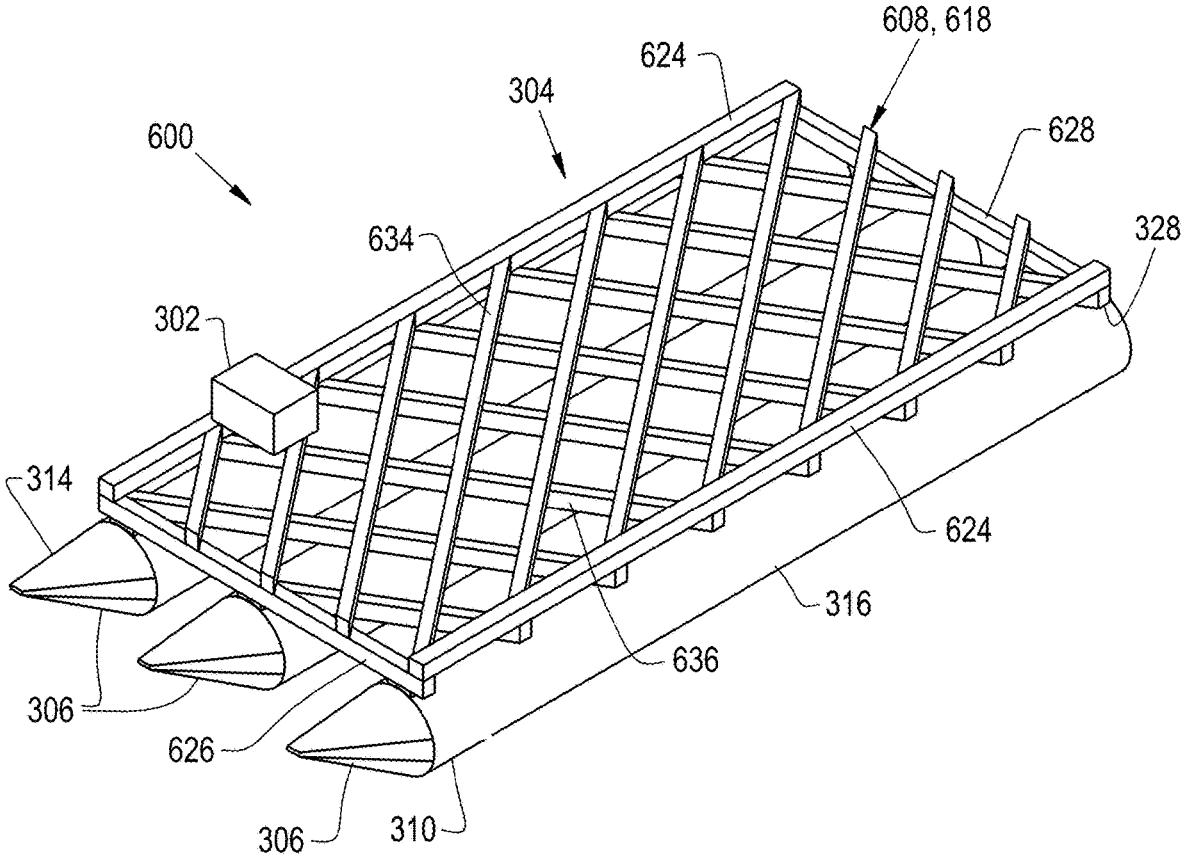
FIG. 6 is a top, perspective view of yet another exemplary embodiment of a watercraft, in accordance with an exemplary embodiment of the present invention.

Referring now to FIG. 6, there is shown a top, perspective view of another embodiment of the chassis of watercraft 600, according to the present invention. Certain prior reference numbers with respect to the chassis are increased by a multiple of 100 and are substantially similar to the structures and function of the embodiments shown in FIGS. 3, unless otherwise shown and/or described. Thus, the chassis and cross-hatched assembly are now labeled 608 and 618, respectively, in FIG. 6. The primary difference between chassis 308 and chassis 608 is in terms of cross-hatched assembly 318 relative to cross-hatched assembly 618. Cross-hatched assembly 618 includes two transverse members 626, 628, two longitudinal members 624, a first plurality of diagonal members 634, and a second plurality of diagonal members 636. Each diagonal member 634, 636 can be made of any suitable material, such as a metal (such as aluminum, or steel), a polymer, carbon fiber, and/or fiberglass. Members 626, 628, 624, 634, 636 can be coupled with one another and pontoons 306 in any suitable manner such as any ways of coupling described herein). Transverse members 626, 628 are positioned at forward and rearward ends 310, 312 of outboard pontoons 314, 316. According to an exemplary embodiment, diagonal members 634 are positioned atop transverse members 626, 628 and are fit between and thus on the same vertical level as longitudinal members 624. Diagonal members 636 are positioned below longitudinal members 624 and are fit between and thus on the same vertical level as transverse members 626, 628. As with braces 532 in FIG. 5, diagonal members 634, 636 provide stiffness and thus protect against racking. According to another embodiment, transvers members 626, 628 and longitudinal members 624 can be omitted, while diagonal members 634, 636 remain, with diagonal members 634, 636 being coupled with pontoons 306 in various places. The embodiment of the present invention shown and/or described with respect to FIG. 6 can also include enclosure 430. Thus, in sum, cross-hatched assembly 618 includes a first plurality of diagonal members 634 and a second plurality of diagonal members 636 coupled with the first plurality of diagonal members 634 and the plurality of pontoons 306.

In use, during manufacture, chassis 308, 408 can be formed using beams 320, 320A, 324 and coupling them together in a cross-hatched pattern such that the longitudinal beams 324 lie perpendicularly with respect to transverse beams 320, 320A. Further, chassis 308, 408 is coupled with pontoons 306. According to an alternative embodiment discussed above, certain ones of beams 320A, 324 can be removed (or, alternatively, formed originally) so as to make room for high-voltage battery pack 430, which can be positioned within, and thus to form part of, cross-hatched assembly 418 of chassis 408. According to another alternative embodiment discussed above, chassis 608 can include diagonal beams 634, 636. Further, any additional structures associated with watercraft body 302 can be connected to chassis 308, 408, 608. Upon assembling watercraft 300, 400, 600, watercraft 300, 400, 600 can be floated or otherwise used on a body of water.

Figure 7:
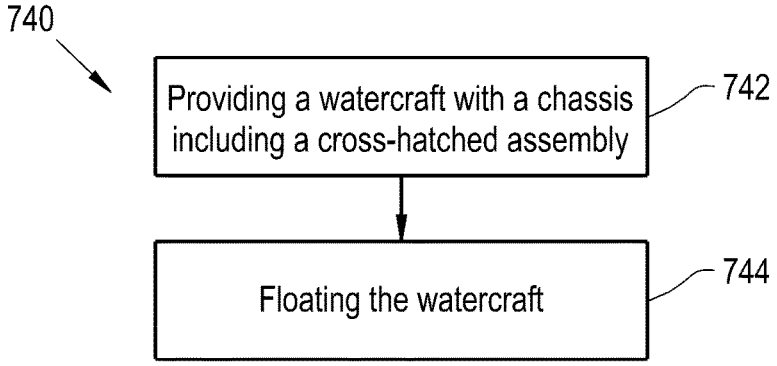
FIG. 7 is a flow diagram showing a method of using a watercraft, in accordance with an exemplary embodiment of the present invention.

Referring now to FIG. 7, there is shown a flow diagram showing a method 740 of using watercraft 300, 400. Method 740 includes the steps of: providing 742 that the watercraft 300 includes: a watercraft body 302; a pontoon frame system 304 coupled with the watercraft body 302, the pontoon frame system 304 including: a plurality of pontoons 306 spaced apart from one another; and a chassis 308, 408 coupled with and at least partially supporting the watercraft body 302, the chassis 308, 408 supported by and coupling together the plurality of pontoons 306, the chassis 308, 408 including a cross-hatched assembly 318, 418; and floating 744 the watercraft 300. Further, the plurality of pontoons 306 can include a forward end 310, a rearward end 312, a first outboard pontoon 314, and a second outboard pontoon 316; and the cross-hatched assembly 318, 418 of the chassis 308, 408 can include: a plurality of transverse members 320, 320A including a first transverse member 326 positioned at the forward end 310 and a second transverse member 328 positioned at the rearward end 312, the first transverse member 326 and the second transverse member 328 each being coupled with the first outboard pontoon 314 and the second outboard pontoon 316; and a support mechanism 322, 422 coupled with, extending longitudinally between, and positioned atop the first transverse member 326 and the second transverse member 328. Further, the plurality of transverse members 320, 320A can include a plurality of first beams 320, 320A, and the support mechanism 322, 422 includes a plurality of longitudinal members 324 which include a plurality of second beams 324. Further, at least one of the plurality of longitudinal members 324 can be positioned transversely offset relative to the plurality of pontoons 306. Further, each of the plurality of longitudinal members 324 can extend from the first transverse member 326 to the second transverse member 328. Further, the support mechanism 422 can include: a plurality of longitudinal members 324 positioned atop the plurality of transverse members 320, respective ones of the plurality of longitudinal members 324 being coupled with the first transverse member 326, and respective ones of the plurality of longitudinal members 324 being coupled with the second transverse member 328; and a rigid enclosure 430 connected to at least two of the plurality of longitudinal members 324, at least one of these two of the plurality of longitudinal members 324 being coupled with the first transverse member 326, and at least another of these two of the plurality of longitudinal members 324 being coupled with the second transverse member 328. Further, cross-hatch assembly 318 can include transverse members 320, 320A, longitudinal members 324 coupled with transverse members 320, 320A, and at least one brace member 532 coupled with and disposed diagonally relative to transverse members 320, 320A and longitudinal members 324. Further, cross-hatched assembly 618 includes a first plurality of diagonal members 634 and a second plurality of diagonal members 636 coupled with the first plurality of diagonal members 634 and the plurality of pontoons 306.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pontoon frame system of a watercraft including a watercraft body, the watercraft body including at least one of a floor, a decking, and a platform, the pontoon frame system being coupled with the watercraft body, the pontoon frame system comprising:

a plurality of pontoons paced apart from one another; and a chassis configured for being coupled with and for at least partially supporting the watercraft body, the chassis supported by and coupling together the plurality of pontoons, the chassis including a cross-hatched assembly, the pontoon frame system having an absence of a floor, a decking, and a platform and thus also a decking platform.

2. The pontoon frame system of claim 1, wherein:

the plurality of pontoons include a forward end, a rearward end, a first outboard pontoon, and a second outboard pontoon; and the cross-hatched assembly of the chassis includes:

a plurality of transverse members including a first transverse member positioned at the forward end and a second transverse member positioned at the rearward end, the first transverse member and the second transverse member each being coupled with the first outboard pontoon and the second outboard pontoon; and a support mechanism coupled with, extending longitudinally between, and positioned atop the first transverse member and the second transverse member.

3. The pontoon frame system of claim 2, wherein the plurality of transverse members include a plurality of first beams, and the support mechanism includes a plurality of longitudinal members which include a plurality of second beams.

4. The pontoon frame system of claim 3, wherein at least one of the plurality of longitudinal members is positioned transversely offset relative to the plurality of pontoons, each of the plurality of longitudinal members extending from the first transverse member to the second transverse member.

5. The pontoon frame system of claim 3, wherein the support mechanism includes:

a plurality of longitudinal members positioned atop the plurality of transverse members, respective ones of the plurality of longitudinal members being coupled with the first transverse member, and respective ones of the plurality of longitudinal members being coupled with the second transverse member; and a rigid enclosure connected to at least two of the plurality of longitudinal members, at least one of these two of the plurality of longitudinal members being coupled with the first transverse member, and at least another of these two of the plurality of longitudinal members being coupled with the second transverse member.

6. A watercraft, comprising:

a watercraft body, the watercraft body including at least one of a floor, a decking, and a platform;

a pontoon frame system coupled with the watercraft body, the pontoon frame system including:

a plurality of pontoons spaced apart from one another; and a chassis coupled with and at least partially supporting the watercraft body, the chassis supported by and coupling together the plurality of pontoons, the chassis including a cross-hatched assembly, the pontoon frame system having an absence of a floor, a decking, and a platform and thus also a decking platform.

7. The watercraft of claim 6, wherein:

the plurality of pontoons include a forward end, a rearward end, a first outboard pontoon, and a second outboard pontoon; and the cross-hatched assembly of the chassis includes:

a plurality of transverse members including a first transverse member positioned at the forward end and a second transverse member positioned at the rearward end, the first transverse member and the second transverse member each being coupled with the first outboard pontoon and the second outboard pontoon; and a support mechanism coupled with, extending longitudinally between, and positioned atop the first transverse member and the second transverse member.

8. The watercraft of claim 7, wherein the plurality of transverse members include a plurality of first beams, and the support mechanism includes a plurality of longitudinal members which include a plurality of second beams.

9. The watercraft of claim 8, wherein at least one of the plurality of longitudinal members is positioned transversely offset relative to the plurality of pontoons, each of the plurality of longitudinal members extending from the first transverse member to the second transverse member.

10. The watercraft of claim 8, wherein the support mechanism includes:

the plurality of longitudinal members positioned atop the plurality of transverse transverse members, respective ones of the plurality of longitudinal members being coupled with the first transverse member, and respective ones of the plurality of longitudinal members being coupled with the second transverse member; and a rigid enclosure connected to at least two of the plurality of longitudinal members, at least one of these two of the plurality of longitudinal members being coupled with the first transverse member, and at least another of these two of the plurality of longitudinal members being coupled with the second transverse member.

11. The watercraft of claim 6, wherein the cross-hatched assembly includes a plurality of transverse members, a plurality of longitudinal members coupled with the plurality of transverse members, and at least one brace member coupled with and disposed diagonally relative to the plurality of transverse members and the plurality of longitudinal members.

12. The watercraft of claim 6, wherein the cross-hatched assembly includes a first plurality of diagonal members and a second plurality of diagonal members coupled with the first plurality of diagonal members and the plurality of pontoons.

13. A method of using a watercraft, the method comprising the steps of:

providing that the watercraft includes:

a watercraft body, the watercraft body including at least one of a floor, a decking, and a platform;

a pontoon frame system coupled with the watercraft body, the pontoon frame system including:

a plurality of pontoons spaced apart from one another; and a chassis coupled with and at least partially supporting the watercraft body, the chassis supported by and coupling together the plurality of pontoons, the chassis including a cross-hatched assembly, the pontoon frame system having an absence of a floor, a decking, and a platform and thus also a decking platform; and floating the watercraft.

14. The method of claim 13, wherein:

the plurality of pontoons include a forward end, a rearward end, a first outboard pontoon, and a second outboard pontoon; and the cross-hatched assembly of the chassis includes:

a plurality of transverse members including a first transverse member positioned at the forward end and a second transverse member positioned at the rearward end, the first transverse member and the second transverse member each being coupled with the first outboard pontoon and the second outboard pontoon; and a support mechanism coupled with, extending longitudinally between, and positioned atop the first transverse member and the second transverse member.

15. The method of claim 14, wherein the plurality of transverse members include a plurality of first beams, and the support mechanism includes a plurality of longitudinal members which include a plurality of second beams.

16. The method of claim 15, wherein at least one of the plurality of longitudinal members is positioned transversely offset relative to the plurality of pontoons, each of the plurality of longitudinal members extending from the first transverse member to the second transverse member.

17. The method of claim 15, wherein the support mechanism includes:

the plurality of longitudinal members positioned atop the plurality of transverse members, respective ones of the plurality of longitudinal members being coupled with the first transverse member, and respective ones of the plurality of longitudinal members being coupled with the second transverse member; and a rigid enclosure connected to at least two of the plurality of longitudinal members, at least one of these two of the plurality of longitudinal members being coupled with the first transverse member, and at least another of these two of the plurality of longitudinal members being coupled with the second transverse member.

18. The method of claim 13, wherein the cross-hatched assembly includes a plurality of transverse members, a plurality of longitudinal members coupled with the plurality of transverse members, and at least one brace member coupled with and disposed diagonally relative to the plurality of transverse members and the plurality of longitudinal members.

19. The method of claim 13, wherein the cross-hatched assembly includes a first plurality of diagonal members and a second plurality of diagonal members coupled with the first plurality of diagonal members and the plurality of pontoons.

20. The watercraft of claim 6, wherein the cross-hatched assembly includes a plurality of transverse members and a plurality of longitudinal members, wherein the plurality of transverse members are spaced apart longitudinally relative to one another, and each of the plurality of longitudinal members are spaced apart transversely relative to one another.

* * * * *